US005923230A

United States Patent [19]

Yoshida et al.

[11] Patent Number: 5,923,230

[45] Date of Patent: Jul. 13, 1999

[54] MEANDER DELAY LINE HAVING DELAY-TIME PEAKS WHICH ARE A FUNCTION OF FREQUENCY

[75] Inventors: Norio Yoshida, Otsu; Makoto Tochigi, Shiga-ken, both of Japan

[73] Assignee: Murata Manufacturing Co., Ltd., Japan

[21] Appl. No.: 08/826,342

[22] Filed: Mar. 26, 1997

[30] Foreign Application Priority Data

Mar. 26, 1996 [JP] Japan ..... 8-70299

[51] Int. Cl.[6] ..... H01P 1/18

[52] U.S. Cl. ..... 333/161; 333/156

[58] Field of Search ..... 333/161, 156

[56] References Cited

U.S. PATENT DOCUMENTS

| | | | |
|---|---|---|---|
| 4,949,057 | 8/1990 | Ishisaki et al. | 333/161 |
| 5,073,755 | 12/1991 | Neufeld | 333/161 X |
| 5,146,191 | 9/1992 | Mandai et al. | 333/161 |

*Primary Examiner*—Benny Lee

*Attorney, Agent, or Firm*—Ostrolenk, Faber, Gerb & Soffen, LLP

[57] ABSTRACT

A delay line is produced by firing a laminated body and terminals (an input terminal, an output terminal and grounding terminals) which are formed by printing or another method on the side faces, top and bottom surfaces of the laminated body. The laminated body has four dielectric rectangular sheet layers (dielectric constant $\epsilon r$=approximately 6.3) containing mainly barium oxide, aluminum oxide and silica. The laminated body is formed by layering from top to bottom, in the order given, a first sheet layer, a second sheet layer which has a grounding conductor formed on its top surface, a third sheet layer which has a transmission line meanderingly formed on its top surface, and a fourth sheet layer which has another grounding conductor formed on its top surface. The transmission line has a meandering shape which defines a meander width, and has delay time peaks at respective frequencies, wherein the frequency fn at the n-th delay time peak substantially satisfies the formula:

$$fn = \frac{(2n-1)Co}{4A\sqrt{\epsilon r}}$$

where Co represents the speed of light; $\epsilon r$, the dielectric constant of the dielectric layer; A, the meander width of the meanderingly formed transmission line; and n, a natural number. The transmission line may be formed by connecting in series a plurality of meanderingly formed transmission line segments having different respective meander widths. The plurality of transmission line segments may be formed opposite each other with the dielectric layer provided therebetween, the plurality of transmission line segments being connected to each other at ends thereof.

8 Claims, 6 Drawing Sheets

MEANDER DELAY LINE HAVING DELAY-TIME PEAKS WHICH ARE A FUNCTION OF FREQUENCY

BACKGROUND OF THE INVENTION

1. Field of the Invention

The present invention relates to delay lines, and in particular to delay lines for delaying transmission of signals in computers, measuring apparatuses and so forth.

2. Description of the Related Art

FIG. 11 shows a known conventional delay line 50 which includes a signal-carrying transmission line 52 which is meanderingly formed on one surface of a dielectric substrate 51, and a grounding conductor (not shown) formed on almost the entire other surface. Grounding terminals 53 and 54 are connected to the grounding conductor. An input terminal 55 and an output terminal 56 are connected to the ends of the transmission line 52. The overall length of the transmission line 52 determines the desired delay time.

A conventional delay line has a frequency dependency in which delay time peaks appear at a plurality of frequencies. As the frequency dependency is independent of external factors, the conventional delay line has a problem in that the frequencies fn at which the n-th delay time peaks occur cannot be controlled.

SUMMARY OF THE INVENTION

Accordingly, an advantageous feature of the present invention is to provide a delay line in which the frequency fn at the n-th delay time peak can be determined in the design phase.

The foregoing can be achieved through the provision of a delay line having a transmission line and a grounding conductor formed opposite each other with a dielectric layer therebetween, in which the pattern of the transmission line is meanderingly formed. In such a delay line, the frequency fn at the n-th delay time peak substantially satisfies the formula:

$$fn = \frac{(2n-1)Co}{4A\sqrt{\epsilon r}}$$

where Co represents the speed of light, $\epsilon r$ represents the dielectric constant of the dielectric layer, A represents the meander width of the meanderingly formed transmission line, and n represents a natural number.

Preferably, the transmission line is formed by connecting in series a plurality of meanderingly formed transmission line segments having different meander widths A.

Further, the plurality of transmission line segments may be formed opposite each other with respect to the dielectric layer provided therebetween, and connected to each other in series by their ends.

According to the present invention, a desired meander width A of a meanderingly formed transmission line can be determined in the design phase without requiring actual measurement of the delay time of the transmission line.

Conversely, by controlling the meander width A of the meanderingly formed transmission line, the frequency dependency of the delay time can be controlled in the design phase.

In addition, by connecting in series a plurality of transmission line segments having different meander widths A, the delay time peaks of the transmission line segments can be canceled. Accordingly, in the design phase a combination of meander widths A can be determined for obtaining a stable delay time within a desired frequency range, whereby both manufacturing time and manufacturing cost can be reduced.

Moreover, by connecting in series a plurality of meanderingly formed transmission line segments having meander widths A with the dielectric layer provided therebetween, the transmission line can be folded in the height direction of a laminated body. Consequently, the size of the delay line can be reduced.

DESCRIPTION OF EMBODIMENTS OF THE INVENTION

By referring to the attached drawings, embodiments of the present invention will be described below.

Figure 1:
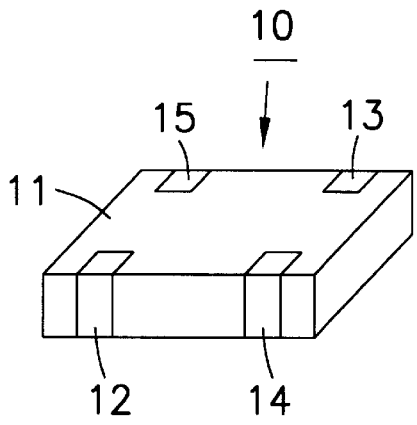
FIG. 1 is a perspective view illustrating a delay line according to a first embodiment of the present invention.
Figure 2:
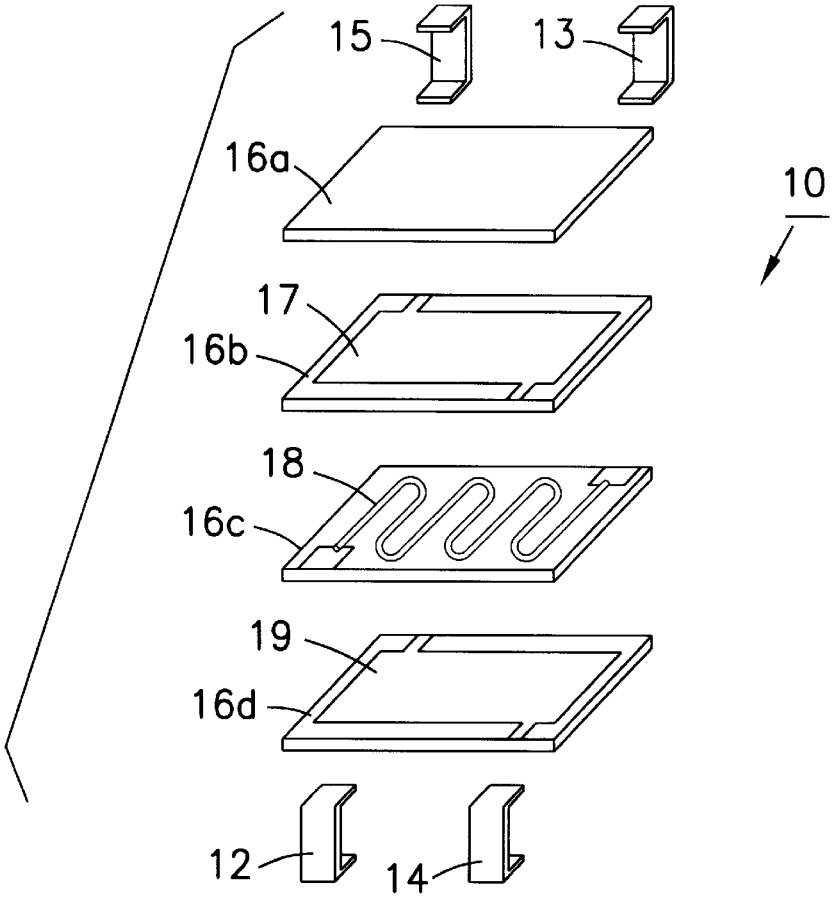
FIG. 2 is an exploded perspective view illustrating the delay line shown in FIG. 1.

In FIG. 1 and FIG. 2, a perspective view and an exploded perspective view of a delay line according to a first embodiment of the present invention are shown, respectively.

A delay line 10 includes a rectangular parallelepiped-shaped laminated body 11 (see FIG. 1), an input terminal 12, an output terminal 13 and two grounding terminals 14, 15, which are formed on side faces and the top and bottom surfaces of the laminated body 11 (see FIG. 1).

As shown in FIG. 2, the laminated body 11 comprises dielectric rectangular sheet layers 16*a*, 16*b*, 16*c* and 16*d* (dielectric constant $\epsilon r$=approximately 6.3) containing mainly barium oxide, aluminum oxide and silica. The laminated body 11 (see FIG. 1) is formed by layering from top to bottom, in the order given, the sheet layer 16*a*, the sheet layer 16*b* which has a grounding conductor 17 formed on its top surface, the sheet layer 16*c* which has a transmission line 18 meanderingly formed on its top surface, and the sheet layer 16*d* which has a grounding conductor 19 formed on its top surface. The delay line 10 is produced by firing the laminated body 11, thereby simultaneously firing all its layers. The four terminals 12, 13, 14 and 15 are formed by printing or another method on the side faces, and the top and bottom surfaces of the laminated body 11. The sheet layers 16*a* to 16*d* are integrated by the firing. The terminals 12 to 15 may be formed before or after the laminated body 11 is fired.

The ends of the transmission line 18 and portions of each grounding conductor 17 or 19 are extended to the side faces of the laminated body 11, to be connected to the input terminal 12, the output terminal 13 and the grounding terminals 14, 15.

Figure 3:
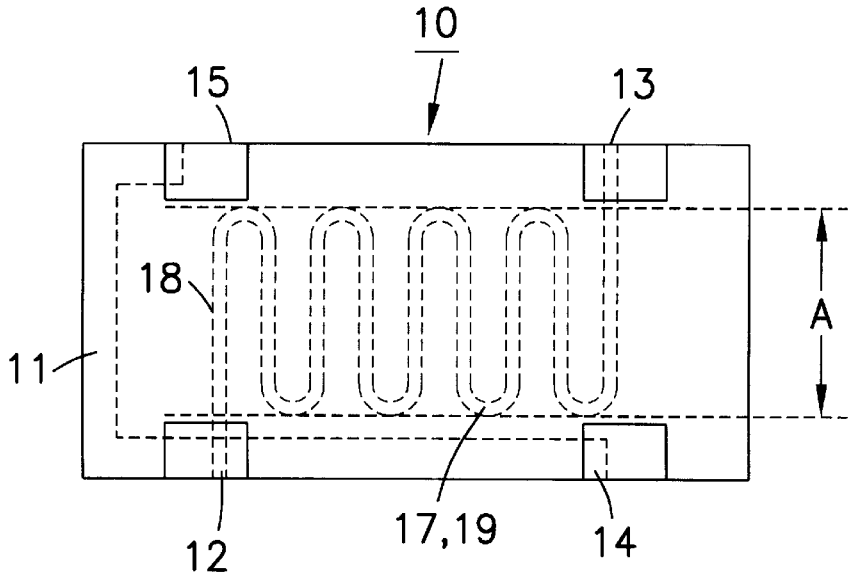
FIG. 3 is a top view illustrating the delay line shown in FIG. 1.

In FIG. 3, a top view of the delay line 10 according to the first embodiment in FIG. 1 is shown. The reference numerals in FIG. 3 have the same meanings as in the other figures. FIG. 3 shows the meander width A of the transmission line 18, i.e., the amplitude of the meandering path of the transmission line 18. In the following Table 1, the meander width A, and measured values and simulated values in connection with the frequency at the first delay time peak, the frequency at the second peak and the frequency at the third peak are shown. While the frequency was being changed, the measured values were obtained for each width A by measurement between the input terminal 12 and the output terminal 13 to which the ends of transmission line 18 were connected.

TABLE 1

| | fn (GHz) | | | | | |
|---|---|---|---|---|---|---|
| | First Peak | | Second Peak | | Third Peak | |
| A (mm) | Simulated Values | Measured Values | Simulated Values | Measured Values | Simulated Values | Measured Values |
| 2.32 | 12.875 | 12.601 | 38.446 | 37.804 | 64.076 | 63.006 |
| 3.30 | 9.045 | 9.400 | 27.135 | 28.200 | 45.224 | 47.000 |
| 4.32 | 6.875 | 7.024 | 20.529 | 21.071 | 34.215 | 35.119 |

TABLE 1-continued

| | fn (GHz) | | | | | |
|---|---|---|---|---|---|---|
| | First Peak | | Second Peak | | Third Peak | |
| A (mm) | Simulated Values | Measured Values | Simulated Values | Measured Values | Simulated Values | Measured Values |
| 6.30 | 4.725 | 4.750 | 14.175 | 14.250 | 23.624 | 23.750 |
| 8.32 | 3.575 | 3.774 | 10.775 | 11.322 | 17.792 | 18.871 |

The above results show that the measured values almost correspond to the simulated values. Also, it has been found by the least squares method that the relationship between the meander width A of the transmission line 18 for the simulated values and the frequency fn at the n-th delay time peak is expressed as follows:

$$fn = \frac{(2n-1)Co}{4A\sqrt{\epsilon r}}$$

where Co represents the speed of light, $\epsilon r$ represents the dielectric constant of the dielectric layer, A represents the meander width of the meanderingly formed transmission line, and n represents a natural number.

The following Tables 2, 3 and 4 show meander widths A of the transmission line 18, simulated values and calculated values obtained from the above formula for the frequency f1 at the first delay time peak, the frequency f2 at the second peak and the frequency f3 at the third peak for an arrangement in which the transmission line 18 and the grounding conductors 17, 19 are formed on dielectric layers of dielectric constant $\epsilon r=1$, $\epsilon r=6.3$ and $\epsilon r=10$, respectively.

TABLE 2

| Dielectric constant ($\epsilon r$) = 1 | | | | | | | | | |
|---|---|---|---|---|---|---|---|---|---|
| | fn (GHz) | | | | | | | | |
| | First Peak | | | Second Peak | | | Third Peak | | |
| A (mm) | Simulated Values | Calculated Values | Errors (%) | Simulated Values | Calculated Values | Errors (%) | Simulated Values | Calculated Values | Errors (%) |
| 6.05 | 13.475 | 12.388 | 8.8 | 39.380 | 37.164 | 6.0 | 63.736 | 61.940 | 2.9 |
| 11.05 | 7.250 | 6.783 | 6.9 | 21.163 | 20.349 | 4.0 | 34.288 | 33.915 | 1.1 |
| 16.25 | 4.925 | 4.612 | 6.8 | 14.375 | 13.836 | 3.9 | 23.000 | 23.060 | −0.3 |

TABLE 3

| Dielectric constant ($\epsilon r$) = 6.3 | | | | | | | | | |
|---|---|---|---|---|---|---|---|---|---|
| | fn (GHz) | | | | | | | | |
| | First Peak | | | Second Peak | | | Third Peak | | |
| A (mm) | Simulated Values | Calculated Values | Errors (%) | Simulated Values | Calculated Values | Errors (%) | Simulated Values | Calculated Values | Errors (%) |
| 2.32 | 12.875 | 12.880 | 0 | 38.466 | 38.639 | −0.5 | 64.076 | 64.398 | −0.5 |
| 3.30 | 9.045 | 9.055 | −0.1 | 27.135 | 27.164 | −0.1 | 45.224 | 45.274 | −0.1 |
| 4.32 | 6.875 | 6.917 | −0.6 | 20.529 | 20.750 | −1.1 | 34.215 | 34.584 | −1.1 |
| 6.30 | 4.725 | 4.743 | −0.4 | 14.175 | 14.229 | −0.4 | 23.624 | 23.715 | −0.3 |
| 8.32 | 3.575 | 3.591 | −0.4 | 10.775 | 10.774 | 0 | 17.792 | 17.957 | −0.9 |

TABLE 4

| | Dielectric constant (εr) = 10 | | | | | | | | |
|---|---|---|---|---|---|---|---|---|---|
| | fn (GHz) | | | | | | | | |
| | First Peak | | | Second Peak | | | Third Peak | | |
| A (mm) | Simulated Values | Calculated Values | Errors (%) | Simulated Values | Calculated Values | Errors (%) | Simulated Values | Calculated Values | Errors (%) |
| 2.30 | 10.325 | 10.305 | 0.2 | 31.259 | 30.915 | 1.1 | 52.684 | 51.525 | 2.2 |
| 4.30 | 5.450 | 5.512 | 1.0 | 16.908 | 16.536 | 2.1 | 28.501 | 27.560 | 3.5 |
| 8.30 | 2.825 | 2.855 | −0.9 | 8.375 | 8.566 | −2.3 | 14.762 | 14.275 | 3.3 |

The above results have verified that the error between the calculated value obtained from the formula and the simulated value is within ±10%.

As described above, in the delay line of the first embodiment, the meander width A of the transmission line is dependent upon the speed of light Co, the dielectric constant εr of the dielectric layer and the frequency fn at the n-th delay time peak, regardless of relative difference of dielectric constant εr. The delay line has the following relationship:

$$fn = \frac{(2n-1)Co}{4A\sqrt{\epsilon r}}$$

where Co represents the speed of light, εr represents the dielectric constant of the dielectric layer, A represents the meander width of the transmission line, and n represents a natural number.

Thus, without actually measuring the delay time of the formed delay line, the desired meander width A of the transmission line can be determined in the design phase.

Conversely, by controlling the width A of the transmission line, the frequency dependency of the delay time can be controlled.

Figure 4:
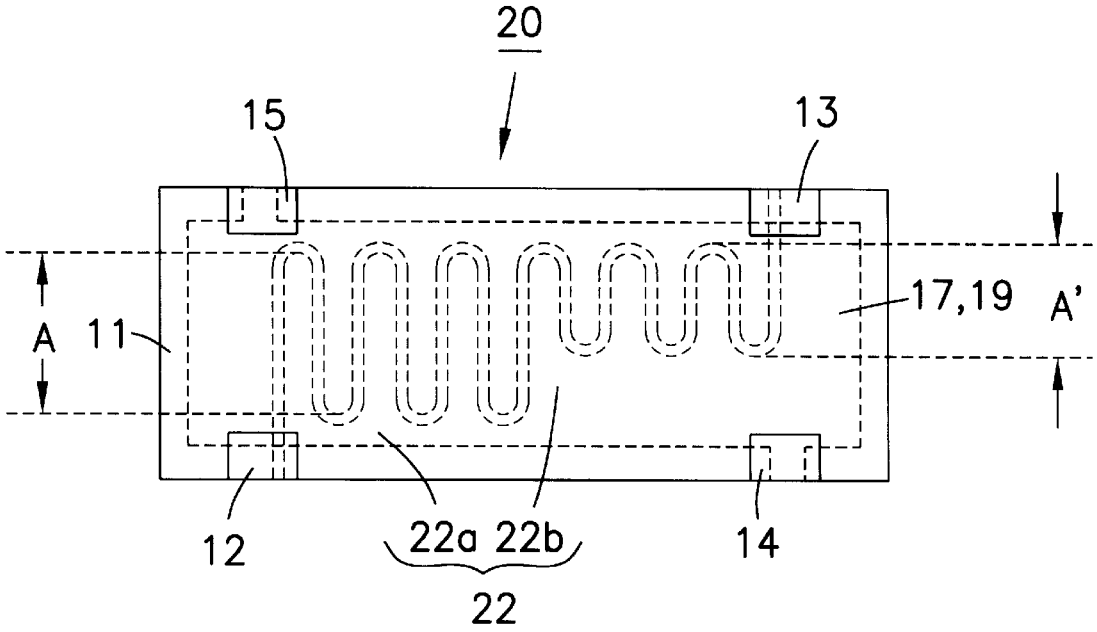
FIG. 4 is a top view illustrating a delay line according to a second embodiment of the present invention.

FIG. 4 shows a top view of a delay line according to a second embodiment of the present invention. Similar to the delay line 10 according to the first embodiment, the delay line 20 includes a rectangular parallelepiped-shaped laminated body 11, a transmission line 22 and grounding conductors 17, 19 formed inside the laminated body 11, an input terminal 12 and an output terminal 13 which are formed on the side faces, and the top and bottom surfaces of the laminated body 11 to which the ends of the transmission line 22 are connected, and grounding terminals 14, 15 to which portions of two grounding conductors 17, 18 are connected.

The transmission line 22 is formed by connecting in series two transmission line segments 22*a*, 22*b* having different respective meander widths A.

The frequency-dependency of delay time of the transmission line having different widths A, obtained by simulation, is shown below.

Figure 5:
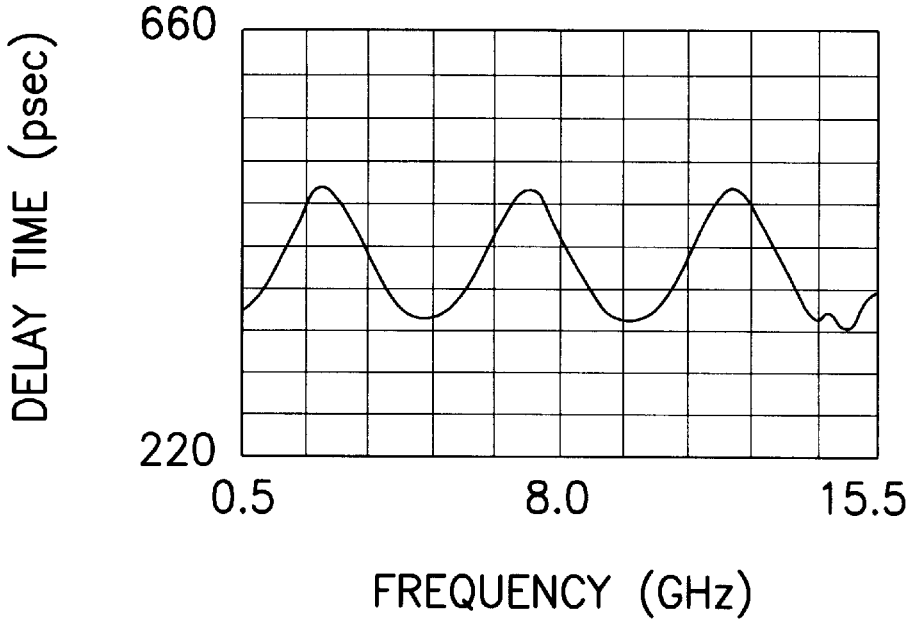
FIG. 5 is a graph showing the frequency dependency of delay time of a transmission line having a meander width of 12 mm.
Figure 6:
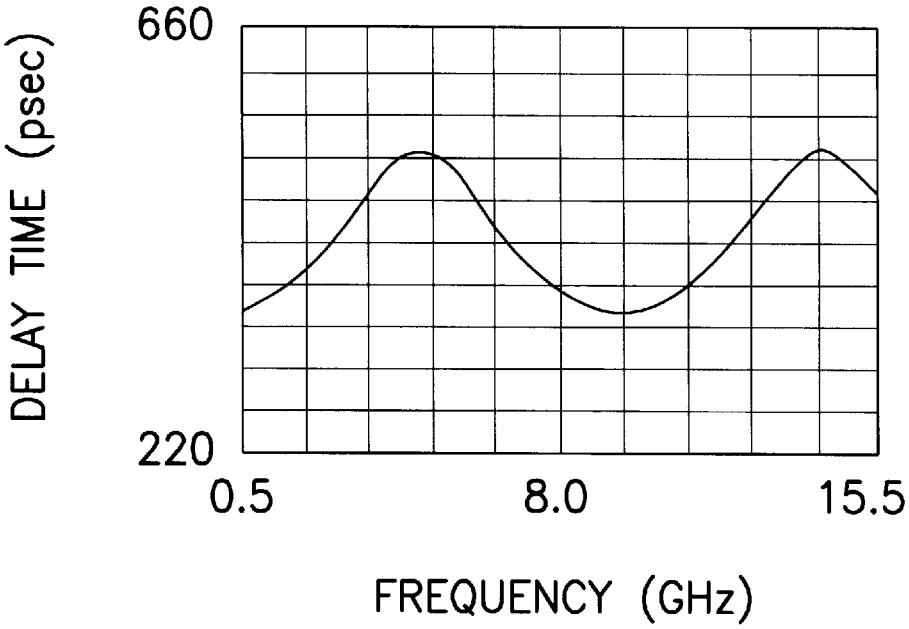
FIG. 6 is a graph showing the frequency dependency of delay time of a transmission line having a meander width of 6 mm.
Figure 7:
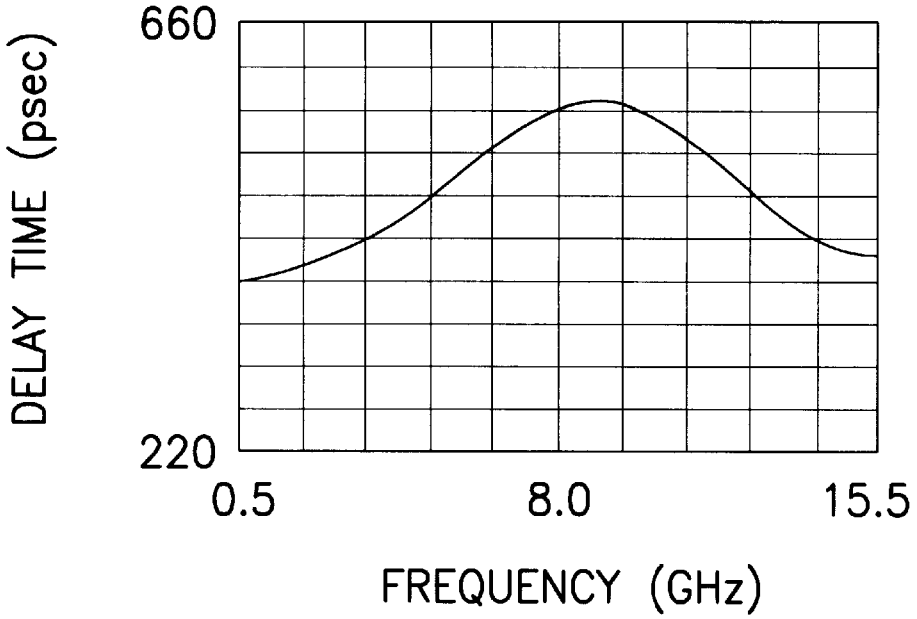
FIG. 7 is a graph showing the frequency dependency of delay time of a transmission line having a meander width of 3 mm.

FIGS. 5 to 7 show the frequency-dependencies of delay time of meanderingly formed transmission lines which having meander widths A and A' of 12 mm, 6 mm and 3 mm.

Figure 8:
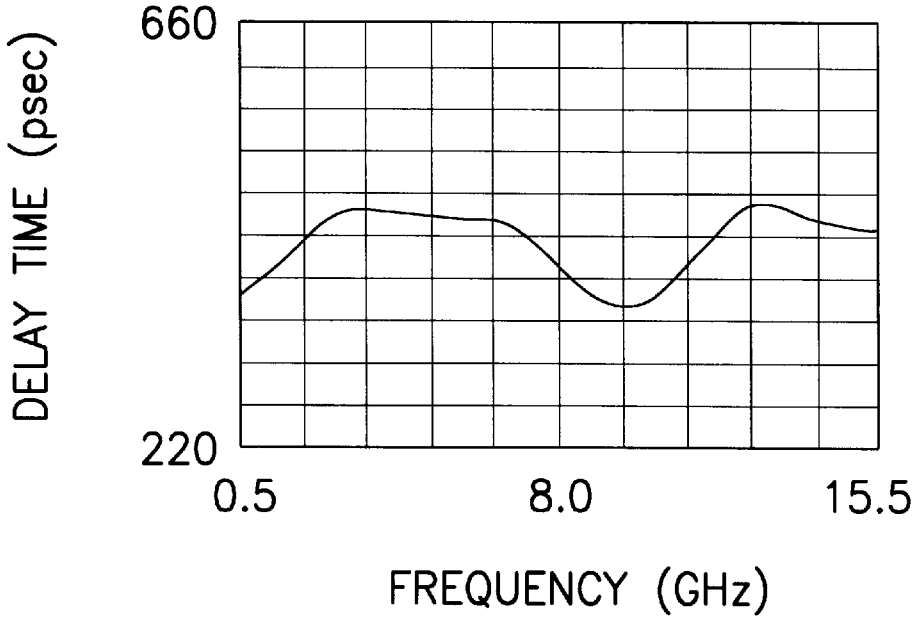
FIG. 8 is a graph showing the frequency dependency of delay time of two transmission lines connected in series, having meander widths of 12 mm and 6 mm.
Figure 9:
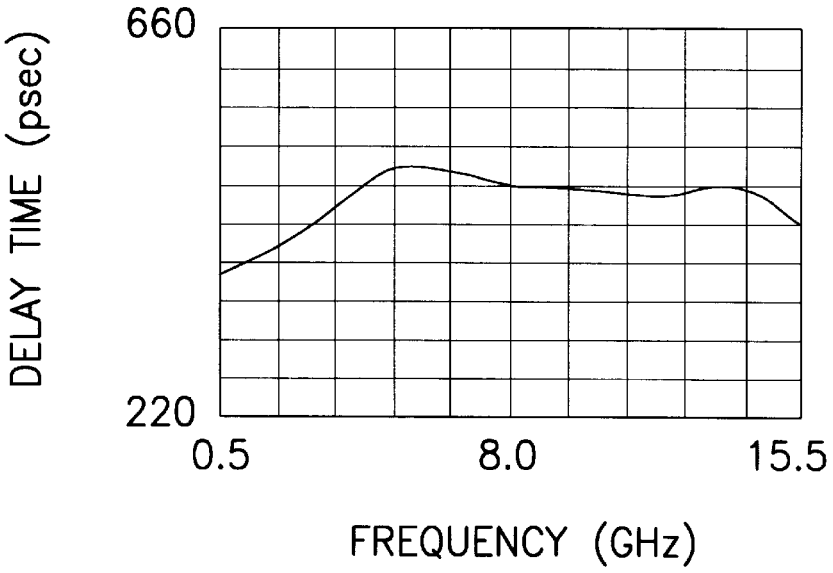
FIG. 9 is a graph showing the frequency dependency of delay time of two transmission lines connected in series, having meander widths of 6 mm and 3 mm.
Figure 11:
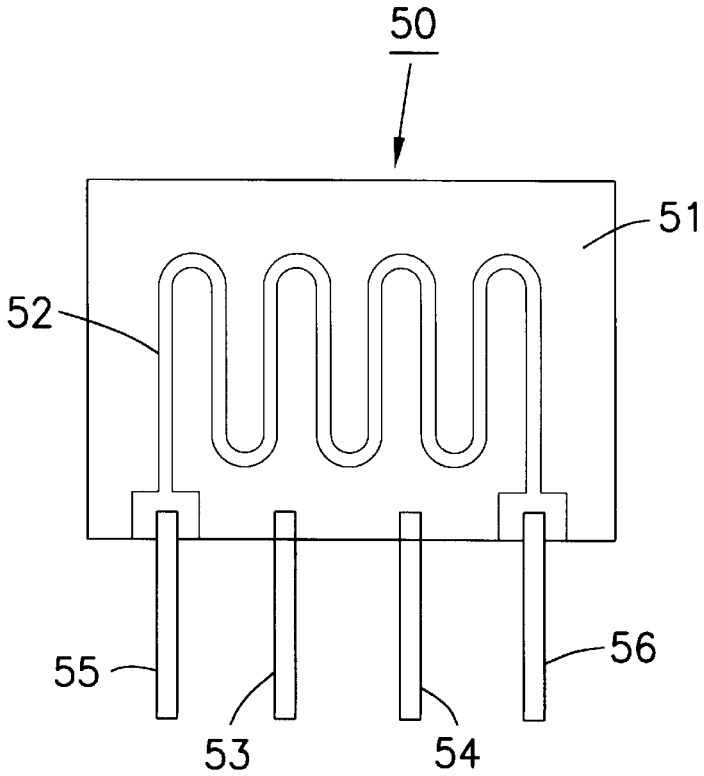
Fig. 11 Prior Art
FIG. 11 is a top view illustrating a conventional delay line.

FIG. 8 shows the frequency-dependency of delay time of a transmission line formed by connecting in series two transmission line segments having meander widths A of 12 mm and 6 mm. FIG. 9 shows the frequency-dependency of delay time of a transmission line formed by connecting in series two transmission line segments having meander widths A of 6 mm and 3 mm.

From FIGS. 5 to 7, it is understood that the n-th peak appears at the corresponding frequency obtained from the above formula, with respect to each width A of the meanderingly formed transmission line.

From FIGS. 8 and 9, it is also understood that connecting in series two meanderingly formed transmission line segments having different meander widths A reduces each peak to form a gradual curve of the frequency dependency of delay time of the transmission line.

In the delay line of the second embodiment, by connecting in series the two meanderingly formed transmission line segments having different meander widths, each delay time peak of each transmission line segment can be canceled. Consequently, in addition to the advantages of the first embodiment, in the design phase a combination of widths A for obtaining stable delay time within a desired frequency range can be determined.

Figure 10:
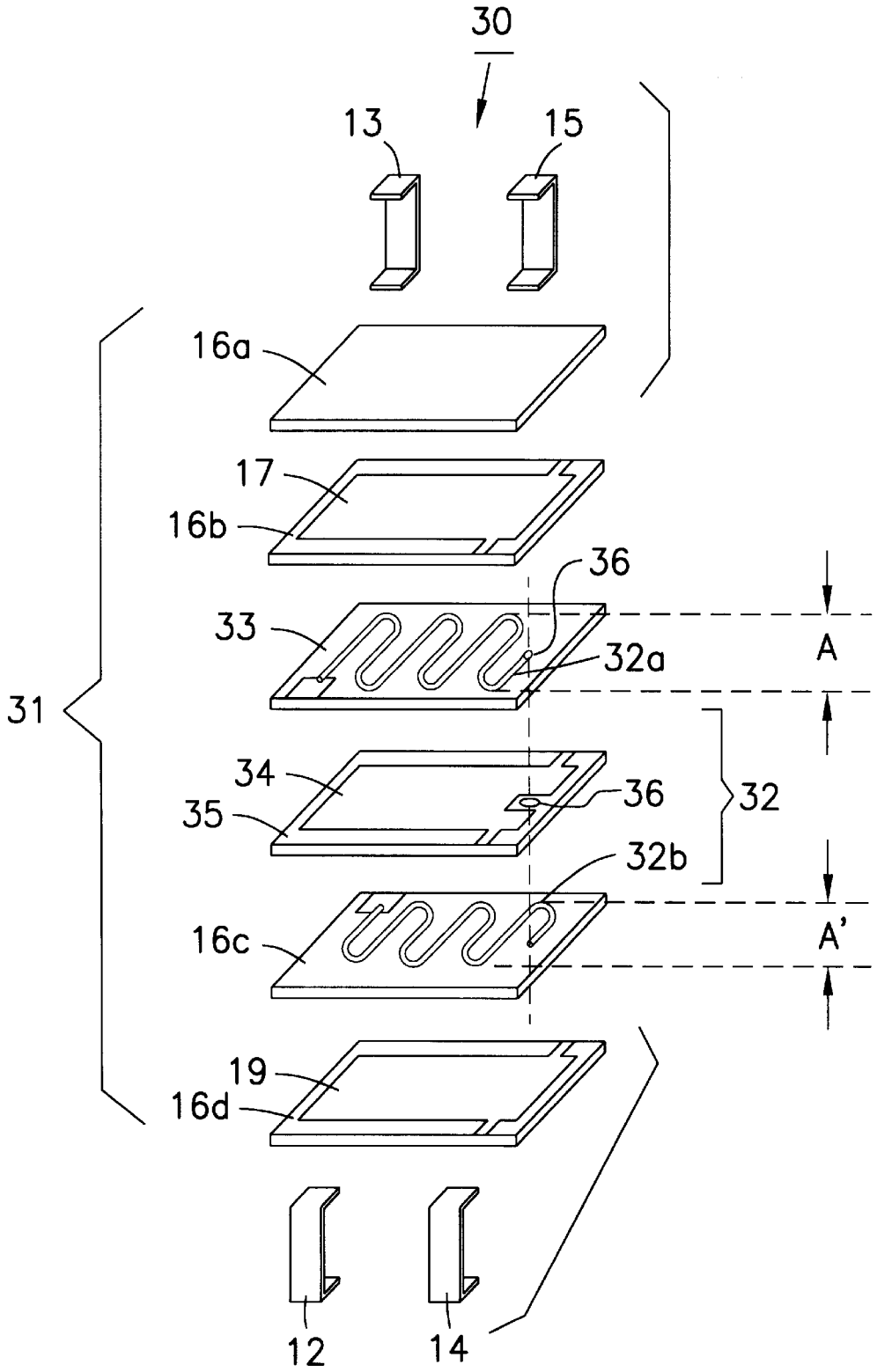
FIG. 10 is an exploded perspective view illustrating a third embodiment of the present invention.

In FIG. 10, an exploded perspective view of a delay line according to a third embodiment of the present invention is shown. The delay line 30 differs from the delay line 20 according to the second embodiment in that two meanderingly formed transmission line segments 32*a*, 32*b* having different respective meander widths A and A', which constitute a transmission line 32 formed inside a laminated body 31, are formed opposite each other with a dielectric layer 33, a grounding conductor 34 and a dielectric layer 35 provided therebetween. The transmission line segments 32*a*, 32*b* are connected by a connection structure, for example by a via 36, to form the transmission line 32. Regarding other portions of FIG. 10, portions identical or equivalent to those in the second embodiment are denoted by the same reference numerals, and a detailed description will be omitted.

According to the third embodiment, the delay line 30 includes the meanderingly formed transmission line segments 32*a*, 32*b* which have different meander widths and are connected in series by the via 36. The dielectric layer 33, the grounding conductor 34 and the dielectric layer 35 are provided therebetween. This arrangement can reduce the size of the delay line 30 in addition to the advantages of the second embodiment.

In the first to third embodiments the dielectric layers are ceramics containing mainly barium oxide, aluminum oxide and silica. However, any material having a dielectric constant of more than 1 may be used, such as ceramics containing mainly magnesium oxide and silica, and fluororesin.

The disclosed embodiments employ strip-type delay lines in which a transmission line is sandwiched between grounding conductors. However, operation and advantages similar to those of the strip type can be obtained by delay lines of a micro-stripline type having one transmission line and only one grounding conductor.

In the disclosed delay lines, the transmission line and the grounding conductor are disposed inside the laminated body. However, they do not need to be inside the laminated body. It is sufficient for the transmission line and the grounding conductor to be disposed with the dielectric layer sandwiched therebetween. Either or both of the transmission line and the grounding conductor may be disposed on one surface of the laminated body.

Although the mentioned laminated bodies are rectangular parallelepiped-shaped, a different shape, for example, cubic, columnar, pyramidal, spherical, and so forth may be used.

In the second and third embodiments the delay lines have two meanderingly formed transmission line segments with different meander widths connected in series. However, more than two connected transmission line segments may be used. With an increased number of transmission line segments, more stable delay time can be obtained within a desired frequency range.

In the third embodiment, two transmission line segments are joined and stacked on top of each other. However, more than two separately formed transmission line segments may be joined and stacked on top of each other. Alternatively, a plurality of layers in which more than one transmission line segments are formed on each layer may be joined, and stacked on top of each other.

In the third embodiment, a via is used as the connection structure between two transmission line segments. However, the connection structure may also comprise a through hole, or a side electrode formed on a side face of the laminated body.

Although the above-described delay lines have a plurality of transmission line segments formed opposite each other with both the dielectric layer and the grounding conductor provided therebetween, the plurality of transmission line segments may be formed with only the dielectric layer provided therebetween. In this case the plurality of transmission line segments are formed to intersect mutually, so little mutual electromagnetic coupling occurs between the transmission line segments, and thus, the grounding conductors are unnecessary.

What is claimed is:

1. A delay line having a transmission line and a grounding conductor arranged opposite each other with a dielectric layer provided therebetween, wherein:

said transmission line has a meandering shape which defines a meander width, and has delay time peaks at respective frequencies, wherein the frequency fn at the n-th delay time peak substantially satisfies the formula:

$$fn = \frac{(2n-1)Co}{4A\sqrt{\epsilon r}}$$

where Co represents the speed of light; $\epsilon r$, the dielectric constant of said dielectric layer; A, the meander width of said meandering shaped transmission line; and n, a natural number.

2. A delay line according to claim 1, wherein said transmission line comprises a plurality of meandering transmission line segments connected in series.

3. A delay line according to claim 2, wherein said plurality of transmission line segments comprises two transmission line segments which are arranged opposite each other with a second dielectric layer arranged therebetween, said second dielectric layer having thereon another grounding conductor.

4. A delay line according to claim 2, wherein the plurality of meandering transmission line segments connected in series respectively have different meander widths.

5. A method of manufacturing a delay line with delay time peaks at predetermined respective frequencies fn, comprising the steps of:

providing a transmission line and a grounding conductor formed opposite each other with a dielectric layer provided therebetween;

providing said transmission line with a meandering shape which defines a meander width A, and providing said delay time peaks at said predetermined respective frequencies fn by setting the meander width A of the transmission line substantially according to the following formula:

$$fn = \frac{(2n-1)Co}{4A\sqrt{\epsilon r}}$$

where Co represents the speed of light; $\epsilon r$, the dielectric constant of said dielectric layer; and n, a natural number.

6. A method according to claim 5, wherein said transmission line is formed by connecting in series a plurality of meanderingly formed transmission line segments.

7. A delay line according to claim 6, wherein said plurality of transmission line segments comprise two transmission line segments which are arranged opposite each other with a second dielectric layer arranged therebetween, said second dielectric layer having thereon another grounding conductor.

8. A method according to claim 6, wherein the plurality of meanderingly formed transmission line segments connected in series respectively have different meander widths.

* * * * *